US006274828B1

(12) United States Patent
Chu

(10) Patent No.: US 6,274,828 B1
(45) Date of Patent: Aug. 14, 2001

(54) ON-OFF SWITCH WITH OFF POSITION LOCKING ACTUATOR

(75) Inventor: Raymond Wai Hang Chu, Chai Wan (HK)

(73) Assignee: Defond Manufacturing Limited (HK)

( * ) Notice: Subject to any disclaimer, the term of this patent is extended or adjusted under 35 U.S.C. 154(b) by 0 days.

(21) Appl. No.: 09/507,452

(22) Filed: Feb. 22, 2000

(51) Int. Cl.[7] ..... H01H 9/28; H01H 3/20
(52) U.S. Cl. ..... 200/43.17; 200/321
(58) Field of Search ..... 200/43.01–43.22, 200/61.58 R, 318–327, 52 R, 61.85, 329–331; 310/50

(56) References Cited

U.S. PATENT DOCUMENTS 3,847,233 * 11/1974 Glover et al. ..... 200/43.17 X
3,873,796 * 3/1975 Worobec, Jr. ..... 200/43.17 X
4,180,716 * 12/1979 Suzuki ..... 200/43.17 X
4,549,097 * 10/1985 Ulmer ..... 200/61.85 X
5,346,342 * 9/1994 Winchester ..... 200/43.17 X
6,057,518 * 5/2000 Bascom et al. ..... 200/43.17
6,091,035 * 7/2000 Campbell et al. ..... 200/321

* cited by examiner

*Primary Examiner*—J. R. Scott
(74) *Attorney, Agent, or Firm*—Leydig, Voit & Mayer, Ltd.

(57) ABSTRACT

An on-off switch for an electric power hand tool such as an electric saw. The switch has a body, a switching mechanism within the body, and a spring-loaded trigger supported by the body for movement between a first position to turn on the switching mechanism and a second position to turn off the switching mechanism. The switch includes a movable locking device resiliently biased by a spring for locking the trigger in the second position against accidental switching on. The trigger and locking device include respective parts for abutment with each other to lock the trigger in the second position.

18 Claims, 3 Drawing Sheets

ON-OFF SWITCH WITH OFF POSITION LOCKING ACTUATOR

The present invention relates to an on-off switch for use in an electric power hand tool.

BACKGROUND OF THE INVENTION

The operation of an electric power hand tool is usually controlled by an on-off switch. As power hand tools would inevitably be subject to impact during arduous handling, care should be taken not to cause the switch to be turned on unintentionally, which may otherwise result in an accident. Most existing switches used in this field are not sufficiently robust.

The invention seeks to mitigate or at least alleviate such a problem by providing an improved on-off switch of this type.

SUMMARY OF THE INVENTION

According to the invention, there is provided an on-off switch for use in an electric power hand tool, which switch comprises a body, a switching mechanism provided within the body, an operator supported by the body for movement between a first position to turn on the switching mechanism and a second position to turn off the switching mechanism, a first spring resiliently biasing the operator towards the second position, and a movable locking device resiliently biased by a second spring for locking the operator in the second position against accidental switching on of the hand tool, the operator and locking device including respective first and second metal parts for abutment with each other to lock the operator in the second position.

Preferably, the first metal part is provided internally of the operator for reinforcement.

More preferably, the first metal part has a shape corresponding to the shape of the operator.

In a preferred embodiment, the locking device includes an actuator movable in opposite first and second directions, being resiliently biased by the second spring in the first direction, for moving the second metal part in the first direction into the path of movement of the first metal part for blocking the movement of the operator from the second position and in the second direction away from the path of movement to allow the operator to move to the first position.

More preferably, the actuator is movable in opposite directions past a central position to reach a side position on either side of the central position, and is resiliently biased by the second spring towards the central position.

Further, more preferably, the actuator has opposite ends to facilitate movement by a person using the hand tool on either side of the switch.

It is preferred that the body include a third metal part which is located behind the second metal part for providing reinforced support for the second metal part when the second metal part is abutted by the first metal part.

Advantageously, the locking device is releasably connected to the body for use and is removable such that the remainder of the switch may be used independently without the locking device.

More specifically, the body includes a pair of opposed hooks for connecting the locking device to the body between them through a snap-fit action.

The invention also provides an electric power hand tool incorporating the on-off switch, in that the hand tool has a body including a handle at which the switch is located for use.

The power hand tool may be an electric saw incorporating a motor-driven circular saw blade.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
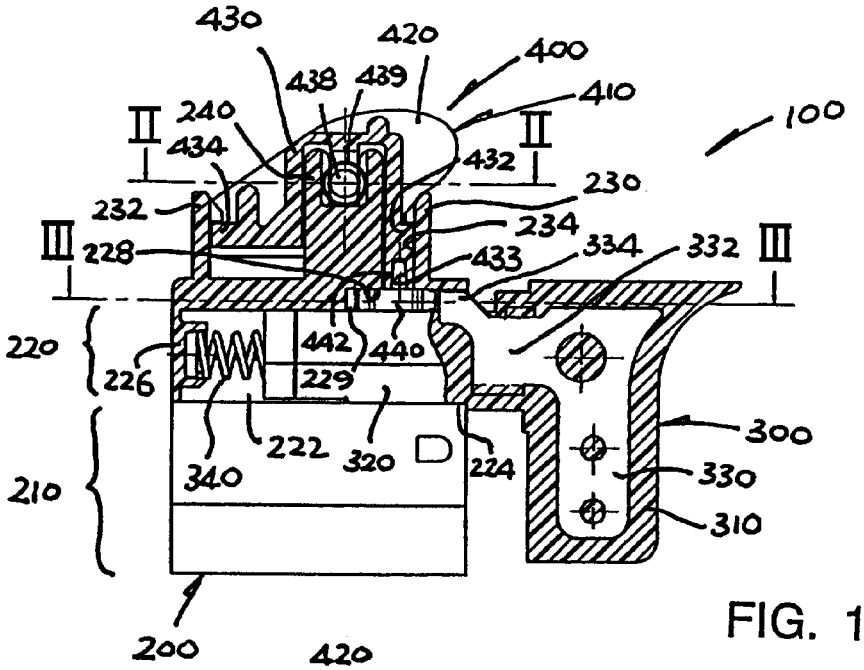
FIG. 1 is a cross-sectional side view of an embodiment of an on-off switch in accordance with the invention.

Referring to the drawings, there is shown an on-off switch 100 embodying the invention for use in an electric power hand tool such as a hand-held electric saw 10, which switch 100 comprises a plastic switch body 200 and a plastic operator in the form of a trigger 300 slidably connected thereto. The switch body 200 has a lower part 210 housing a known switching mechanism (not shown), and an upper part 220 formed internally with a horizontal linear slideway 222 of a generally uniform rectangular cross-section. The slideway 222 has an open front end 224 and a closed rear end 226. The switching mechanism is typically formed by two fixed contacts and a movable contact for movement by the trigger 300 to make and break electrical connection between the fixed contacts, thereby switching on and off the electric saw 10.

The trigger 300 has a body 310 and a rearwardly extending integral shaft 320. The trigger body 310 is insert-molded internally with a one-piece central metal plate 330 for reinforcement, which has a shape corresponding to (and smaller than) the shape of the body 310. The plate 330 has a front part 332 extending into the adjacent end of the shaft 320. This part 332 includes a small corner 334 that protrudes from the upper side of the shaft 320 as a rib-like abutment 334.

The shaft 320 has a generally uniform rectangular cross-section and fits slidably into the slideway 222. At the front end 224, the upper wall of the slideway 222 includes an inverted rectangular flat recess 228 for accommodating, inter alia, the abutment 334 of the shaft 320. A laterally extending metal bar 229 is located against the innermost end or side of the recess 228.

Inter-engageable snap-fitting means are provided between the outer surface of the trigger shaft 320 and the inner surface of the switch body slideway 222 such that, upon insertion, the shaft 320 engages internally the slideway 222 and cannot subsequently be removed. An internal compression coil spring 340 co-acts between the rearmost end of the shaft 320 and the rear end 226 of the slideway 222 for resiliently biassing the trigger 300 outwards. Under the action of the spring 340, the trigger 300, normally projects outwards and switches off the said switching mechanism. Upon pressing, the trigger 300 moves inward and switches on the switching mechanism for as long as the pressing force lasts.

The on-off switch 100 includes a locking device 400 for locking the switch 100 off against unintended or accidental switching on, by obstructing the inward movement of the trigger 300.

Upstanding from the upper part 220, the switch body 200 is integrally, includes a pair of confronting front and rear hooks 230 and 232 at opposite ends and a generally rectangular block 240 between them. The block 240 has, at its upper end, a transversely extending channel 242 having opposite restricted open ends 244. The portion of the upper wall of the body part 220 between the front hook 230 and the block 240 is void, thereby forming a vertical aperture 234 in communication with the recess 228 below.

The locking device 400 incorporates a elongate plastic actuator 410 which has opposite left and right ends 420 having an oval cross-section and an integral middle section 430. The middle section 430 has front and rear edges 432 and 434 and includes a downwardly facing rectangular recess 436. The recess 436 contains a metal bar 438 extending centrally across its opposite left and right sides and a compression coil spring 439 disposed on the bar 438. The spring 439 is fixed at mid-length centrally on the bar 438, but its opposite ends remain free to extend and retract.

The actuator 410 is supported to extend transversely atop the switch body 200 by having its middle section 430 snap-fitted between the hooks 230 and 232 and, more specifically, the front and rear section edges 432 and 434 retained by the hooks 230 and 232 respectively. The front side (edge) 432 of the middle section 430 extends downwards through the vertical aperture 234 to reach the recess 228 and includes a bottom hole 433 having a rectangular cross-section. The section recess 436 encloses the upper end of the block 240, with the bar 438 extending within the channel 242 and the spring 439 held captive between the channel ends 244.

Figure 2:
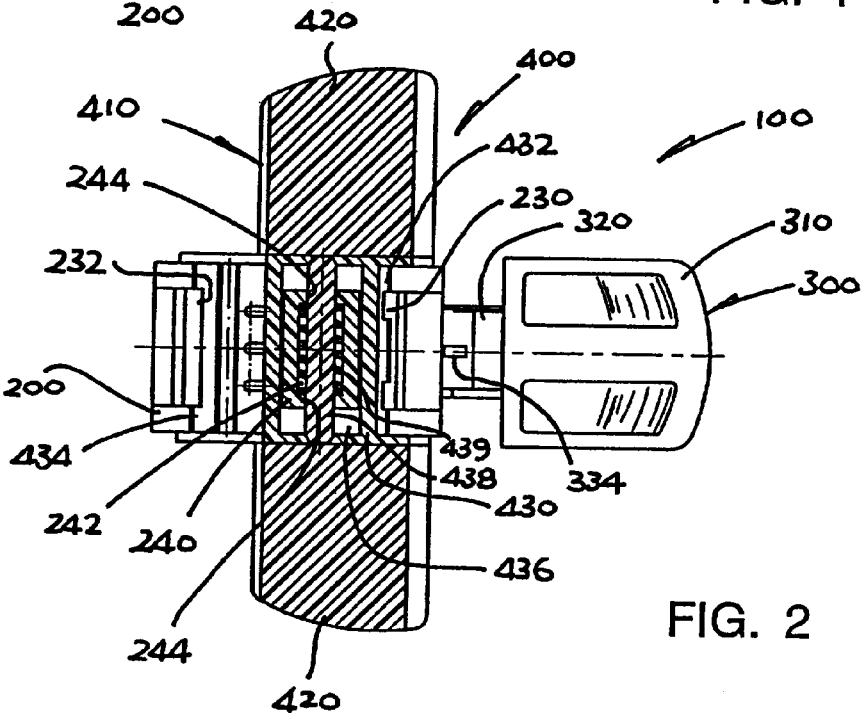
FIG. 2 is a cross-sectional top plan view of the switch of FIG. 1, taken along line II—II, with the switch being in a locked-off condition.
Figure 4:
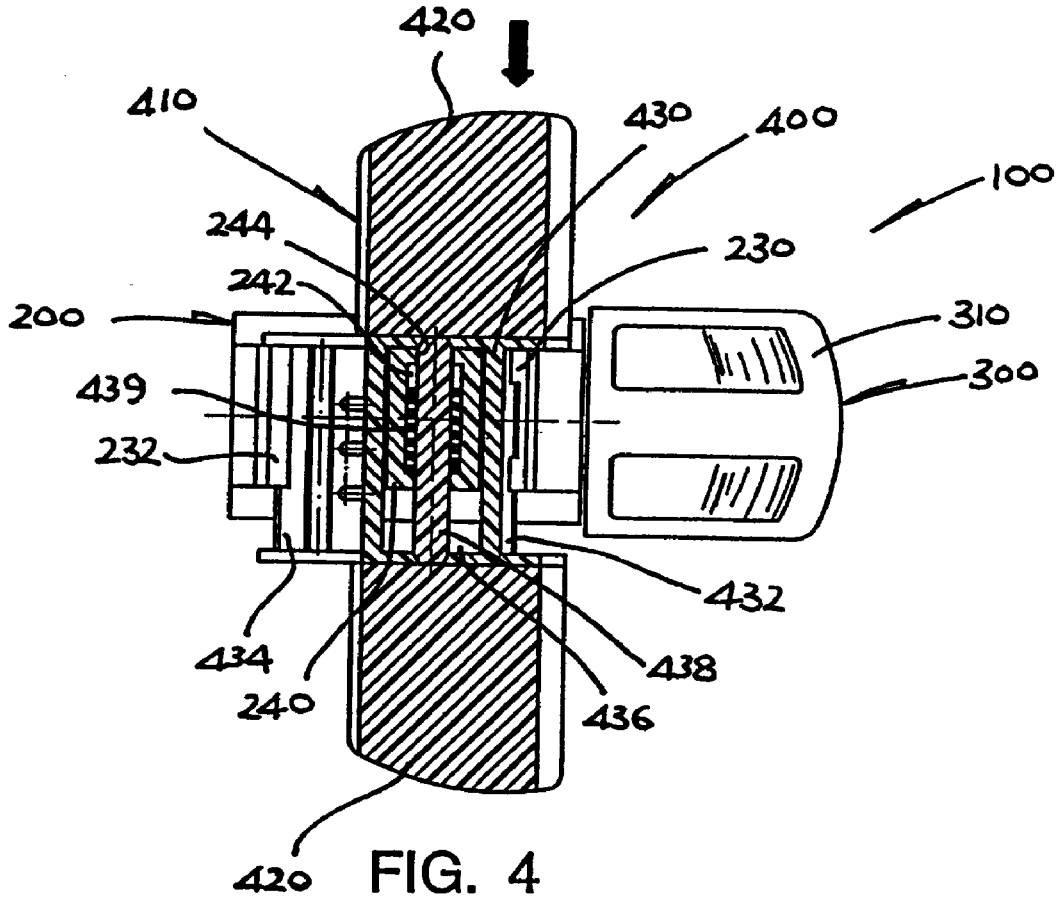
FIG. 4 is a cross-sectional top plan view of the switch of FIG. 1, taken along line II—II, with the switch being in an unlocked condition.

Taking in the longitudinal direction of the actuator 410, the dimension of the recess 436 is greater than that of the block 240. This allows the actuator 410 to slide lengthwise in opposite directions, to a limited extent, relative to the switch body 200. The spring 439 acts symmetrically in opposite directions to resiliently bias the actuator 410 into a normal central position (FIG. 2). The actuator 410 is slidable in either opposite direction, against the action of the spring 439, into a respective side position (FIG. 4).

The locking device 400 includes a flat metal locking member 440, located immediately below the front side 432 of the actuator section 430 and contained within the recess 228. The locking member 440 extends parallel to the abutment 334 and perpendicular to the bar 229 inside the recess 228. The locking member 440 has an upstanding pin 442 which has a rectangular cross-section and is engaged with the bottom hole 433 of the section side 432 for lateral movement by the actuator 410.

Figure 3:
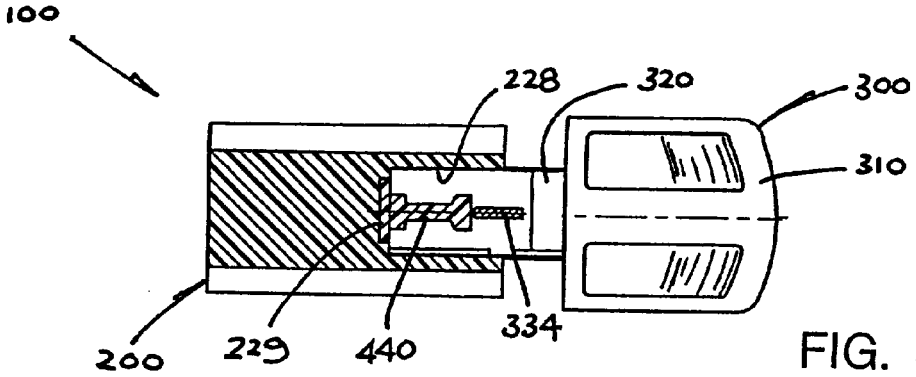
FIG. 3 is a cross-sectional top plan view of the switch of FIG. 1, taken along line III—III, with the switch being in the same condition as shown in FIG. 2.
Figure 5:
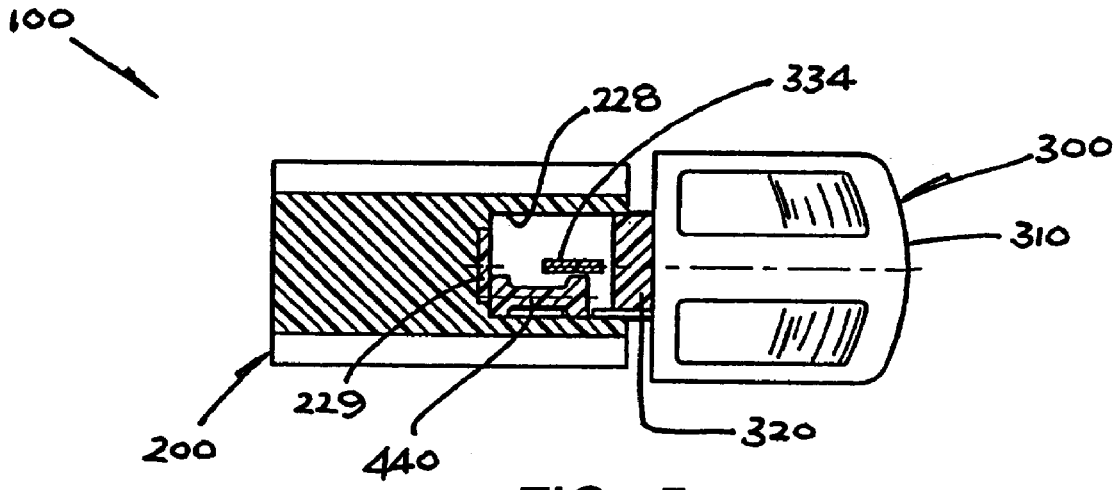
FIG. 5 is a cross-sectional top plan view of the switch of FIG. 1, taken along line III—III, with switch being in the same condition as shown in FIG. 4.

In operation, while the actuator 410 stays normally in the central position (FIG. 2), the locking member 440 extends in line with and close between the abutment 334 and the bar 229 (FIG. 3), thereby lying in the path of movement of the abutment 334 and blocking it and hence the overall trigger 300 against any inward movement. The bar 229 serves to provide reinforced support for the locking member 440 from behind. When the actuator 410 is slid to reach either opposite side position (FIG. 4), the locking member 440 moves laterally away from the path of movement of the abutment 334 (FIG. 5), thereby allowing the trigger 300 to be pressed inwards.

The locking device 400 is designed to lock the switch 100 off against any unintended or accidental switching on of the electric saw 10, which can withstand a minimum impact force up to

300N. In order to switch on the electric saw 10, the actuator 410 should initially be slid sideways before the trigger 300 can be pressed.

Figure 6:
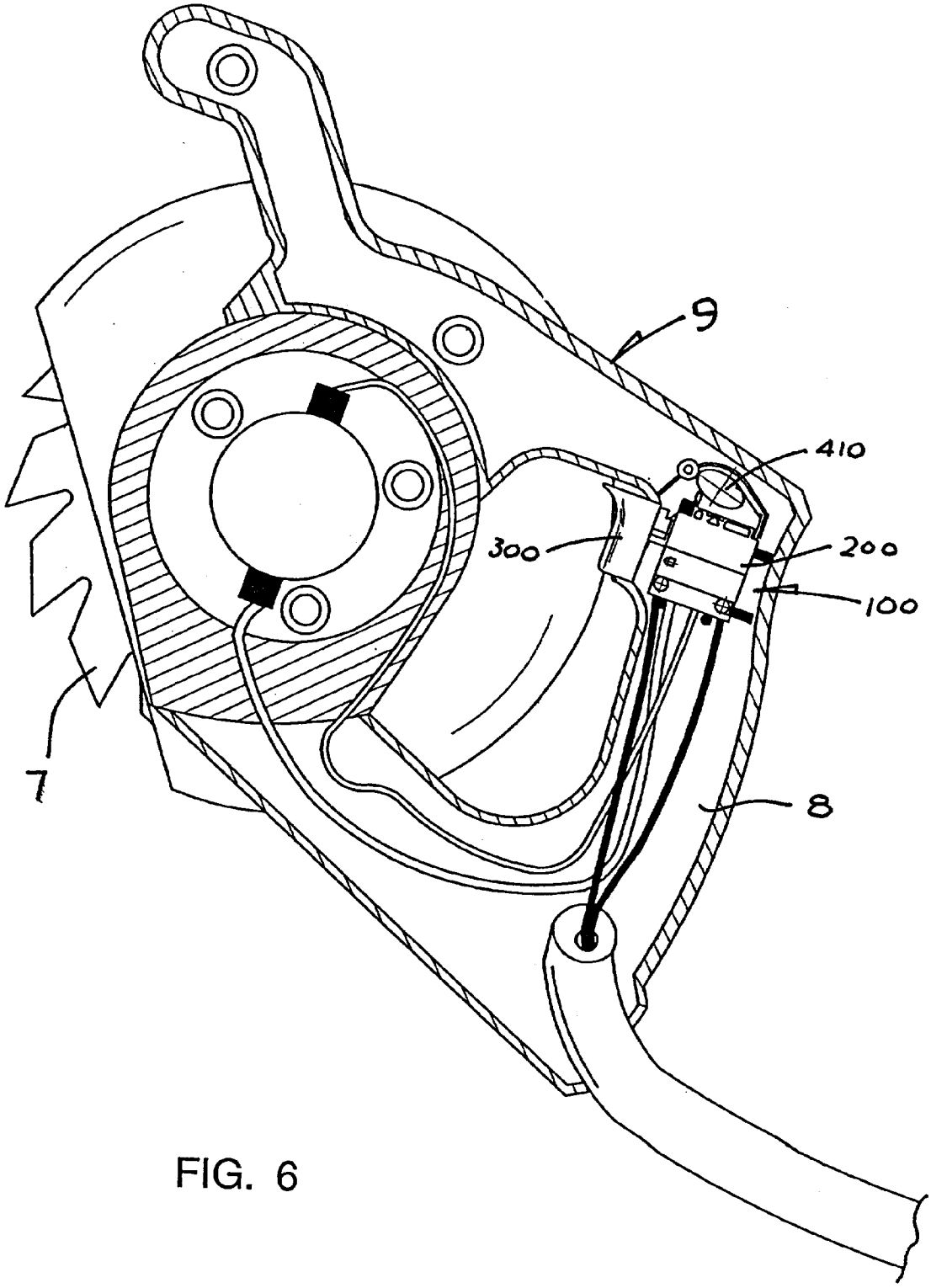
FIG. 6 is a cross-sectional side view of an electric power hand tool incorporating the switch of FIG. 1.

As shown in FIG. 6, the electric saw 10 has a body 9 including a handle 8 at which the on-off switch 100 is located for controlling the operation of a motor-driven circular saw blade 7. The left and right ends 420 of the actuator 410 protrude from opposite sides of the handle 8 to facilitate the movement of the actuator 410 by a person using the electric saw 10 on either side.

It should be noted that the snap-fit connection of the actuator 410 to the switch body 200 is releasable by deforming either of hooks, 230 and 232 outwards, such that the actuator 410 may be removed. The remainder of the on-off switch 100 may then be used independently as a normal switch without the locking-off function.

It is envisaged that the subject on-off switch may be used in any other electric power hand tools, such as a drill or a grinder and that its operator may take any form other than a trigger, such as a pushbutton, a sliding knob or a lever.

The invention has been given by way of example only, and various modifications of and/or alterations to the described embodiment may be made by persons skilled in the art without departing from the scope of the invention as specified in the appended claims.

What is claimed is:

1. An on-off switch with a lock for preventing unintentional closing of the on-off switch, the on-off switch comprising:

a body;

an electrical switching mechanism within the body and having electrical contacts that are selectively electrically closed and electrically open;

an operator slidingly supported by the body and manually slidable along a first direction between a first position in which the electrical contacts of the switching mechanism are closed and a second position in which the electrical contracts of the switching mechanism are open;

a metal blade protruding from the operator and extending along the first direction;

first spring biasing the operator toward the second position; and a locking device including:

a metal locking member alignable with the blade, in a locking position, for preventing sliding of the operator from the second position to the first position by being interposed between the metal blade and the body, the metal locking member being slidable within the body along a second direction, transverse to the first direction, to a releasing position, out of alignment with the metal blade, for sliding of the operator to the first position from the second position;

an actuator engaging the metal locking member and manually slidable along the second direction, and a second spring biasing the actuator toward a locking position in which the metal locking member is aligned with the blade.

2. The on-off switch as claimed in claim 1, wherein the locking device is releasably mountable on the body so that the switch may be used without the locking device.

3. The on-off switch as claimed in claim 2, wherein the body includes a pair of hooks for engaging the locking device to connect the locking device to the body.

4. The on-off switch as claimed in claim 1, wherein the actuator and the metal locking member include a complementary pin and recess, the recess receiving the pin, engaging the actuator with the metal locking member.

5. The on-off switch as claimed in claim 4, wherein the pin extends along a third direction, transverse to both the first and second directions.

6. The on-off switch as claimed in claim 1, wherein the actuator is biased by the second spring toward a central position relative to the body, the central position corresponding to the locking position, and the actuator is slidable to either of two releasing positions along the second direction, on opposite sides of the central position, removing the metal locking member from alignment with the metal blade so the operator can slide to the first position from the second position.

7. The on-off switch as claimed in claim 6, wherein the actuator includes first and second protruding ends for operation of the actuator from either side of the operator.

8. The on-off switch as claimed in claim 1, wherein the body is plastic and includes a metal reinforcement plate transverse to the first direction and contacted by the metal locking member when the locking member is in the locking position and the operator is prevented from sliding to the first position from the second position.

9. The on-off switch as claimed in claim 1, wherein the first and second springs are helical springs.

10. An electrical power hand tool including:

a case having a handle; and an on-off switch located in the handle, the on-off switch comprising:

a body;

an electrical switching mechanism within the body and having electrical contacts that are selectively electrically closed and electrically open;

an operator slidingly supported by the body and manually slidable along a first direction between a first position in which the electrical contacts of the switching mechanism are closed and a second position in which the electrical contracts of the switching mechanism are open;

a metal blade protruding from the operator and extending along the first direction;

first spring biasing the operator toward the second position; and a locking device including:

a metal locking member alignable with the blade, in a locking position, for preventing sliding of the operator from the second position to the first position by being interposed between the metal blade and the body, the metal locking member being slidable within the body along a second direction, transverse to the first direction, to a releasing position, out of alignment with the metal blade, for sliding of the operator to the first position from the second position;

an actuator engaging the metal locking member and manually slidable along the second direction, and a second spring biasing the actuator toward a locking position in which the metal locking member is aligned with the blade.

11. The electrical power hand tool as claimed in claim 10, wherein the locking device is releasably mountable on the switch and so that the power hand tool may be used without the locking device.

12. The electrical power hand tool as claimed in claim 11, wherein the body includes a pair of hooks for engaging the locking device to connect the locking device to the body.

13. The electrical power hand tool as claimed in claim 10, wherein the actuator and the metal locking member include a complementary pin and recess, the recess receiving the pin, engaging the actuator with the metal locking member.

14. The electrical power hand tool as claimed in claim 13, wherein the pin extends along a third direction, transverse to both the first and second directions.

15. The electrical power hand tool as claimed in claim 10, wherein the actuator is biased by the second spring toward a central position relative to the body, the central position corresponding to the locking position, and the actuator is slidable to either of two releasing positions along the second direction, on opposite sides of the central position, removing the metal locking member from alignment with the metal blade so the operator can slide from the first position to the second position.

16. The electrical power hand tool as claimed in claim 15, wherein the actuator includes first and second protruding ends for operation of the actuator from either side of the operator.

17. The electrical power hand tool as claimed in claim 10, wherein the body is plastic and includes a metal reinforcement plate transverse to the first direction and contacted by the metal locking member when the metal locking member is in the locking position and the operator is prevented from sliding to the first position from the second position.

18. The electrical power hand tool as claimed in claim 10, wherein the first and second springs are helical springs.

* * * * *